US006356011B1

(12) United States Patent
Park

(10) Patent No.: US 6,356,011 B1
(45) Date of Patent: Mar. 12, 2002

(54) ELECTRON GUN FOR CATHODE RAY TUBE

(75) Inventor: In-Kyu Park, Suwon-si (KR)

(73) Assignee: Samsung Display Devices Co., LTD, Kyungki-Do (KR)

( * ) Notice: Subject to any disclaimer, the term of this patent is extended or adjusted under 35 U.S.C. 154(b) by 0 days.

(21) Appl. No.: 09/440,141

(22) Filed: Nov. 15, 1999

(30) Foreign Application Priority Data

Mar. 6, 1999 (KR) ..... 99-7429

(51) Int. Cl.[7] ..... H01J 29/38

(52) U.S. Cl. ..... 313/414; 313/412; 313/428; 313/432; 313/439; 315/15; 315/382

(58) Field of Search ..... 313/414, 412, 313/428, 432, 439; 315/382, 15

(56) References Cited

U.S. PATENT DOCUMENTS 5,212,423 A * 5/1993 Noguchi et al. ..... 313/414
5,610,481 A * 3/1997 Shirai et al. ..... 313/414 X

* cited by examiner

*Primary Examiner*—Ashok Patel
(74) *Attorney, Agent, or Firm*—Christie, Parker & Hale, LLP

(57) ABSTRACT

An electron gun for a cathode ray tube includes a triode portion composed of three cathodes arranged in a horizontal line, and control and screen electrodes sequentially placed next to the cathode. First to fourth focusing electrodes are sequentially arranged one after another next to the screen electrode. The first focusing electrode has a first side facing the screen electrode and a second side facing a second focusing electrode. Three circular-shaped beam passage holes are formed in both sides of the first focusing electrode. The second focusing electrode has a first side facing the first focusing electrode and a second side facing the third focusing electrode. Three vertically elongated beam passage holes are formed in the first side facing the first focusing electrode and three circular-shaped beam passage holes are formed in the second side facing the third focusing electrode. The third focusing electrode has a first side facing the second focusing electrode and a second side facing the fourth focusing electrode. Three circular-shaped beam passage holes are formed in the first side facing the second focusing electrode and three vertically elongated beam passage holes are formed in the second side facing the fourth focusing electrode. The fourth focusing electrode has a first side with a common hole for allowing passage of the three electron beams. A final accelerating electrode placed next to the fourth focusing electrode. A static voltage is applied to the first and third focusing electrodes, whereas a dynamic voltage is applied to the second and fourth focusing electrodes.

12 Claims, 8 Drawing Sheets

ELECTRON GUN FOR CATHODE RAY TUBE

FIELD OF THE INVENTION

The present invention relates to an electron gun for a cathode ray tube (CRT) and, more particularly, to an electron gun for a CRT that can produce uniformly-shaped electron beam spots over the entire screen area.

BACKGROUND OF THE INVENTION

Generally in CRTs, the resolution of the display screen is largely dependent upon electron beam spot characteristics. To obtain a high-resolution display screen, electron beams should land over the overall screen area without any halo.

However, in the usual in-line type of electron guns having focusing and accelerating electrodes, electron beam spots may be horizontally distorted because cathodes for emitting thermal electrons to form red R, green G and blue B electron beams, and beam-passing holes of the electrodes are aligned in a horizontal line respectively.

Furthermore, non-uniform deflection magnetic fields generated by a deflection unit whose horizontal deflection field is pincushion-shaped and vertical deflection field is barrel-shaped are applied to the electron beams to deflect them in horizontal and vertical directions. These nonuniform deflection magnetic fields cause a focus defect called "astigmatism" so that the resulting beam spots are liable to be distorted. As a result, the resolution of the display screen is seriously deteriorated.

Therefore, to solve such problems, a dynamic focusing electrode has been conventionally employed in the electrode system. In such a dynamic focusing electrode-based electron gun, the dynamic focusing electrode is applied with a relatively higher voltage than a static focus voltage so that the beam deflection deviation can be compensated for and electron beams deflected to land on the peripheral portion of the screen.

FIG. 11 is a cross sectional view of a prior art dynamic focusing electrode-based electron gun. The electron gun includes a triode portion composed of three cathodes 1 arranged in a horizontal plane, a control grid 3 and a screen grid 5. The cathodes 1, the control grid 3 and the screen grid 5 are sequentially disposed one after another to generate three electron beams of R, G and B. The electron gun further includes a static focusing electrode 7, a dynamic focusing electrode 9 and an accelerating electrode 11, that jointly constitute a main lens portion. The main lens portion accelerates and focuses the electron beam onto the screen. The static focusing electrode 7 and the dynamic focusing electrode 9 have lateral sides facing each other, where the lateral side of the former is formed with horizontally extended beam-guide holes 7*a* and the lateral side of the latter with vertically extended beam-guide holes 9*a*.

In operation, a static focus voltage Vf is applied to the static focusing electrode 7, an anode voltage Ve, higher than the static focus voltage Vf, is applied to the final accelerating electrode, and a dynamic focus voltage Vd is applied to the dynamic focusing electrode 9. The dynamic focus voltage Vd is synchronized with a deflection signal of a deflection unit (not shown).

When the electron beam scanning operation is performed with respect to the central portion of the display screen, the dynamic focus voltage Vd is not applied to the dynamic focusing electrode 9 so that substantially circular-shaped beams land on that central screen portion.

In contrast, when the electron beam scanning operation is performed with respect to the peripheral portion of the display screen, the dynamic focus voltage Vd is applied to the dynamic focusing electrode 9. At this time, a 4-pole lens 13 is formed between the static focusing electrode 7 and the dynamic focusing electrode 9 to compensate for deviant deflection of the electron beams due to a lens 15 formed by the deflection unit. In this way, the deflected electron beams can land on that peripheral screen portion with a substantially circular-shaped spot.

However, when an abnormally high or low voltage happens to be applied to the dynamic focusing electrode, the aforementioned prior art electron gun is not equipped with a suitable means for remedying the abnormality, and hence the resulting abnormal dynamic lens cannot properly perform its function of compensating for distortion of the electron beams due to the non-uniform deflection magnetic fields. It naturally follows that the resulting beam spots are distorted.

SUMMARY OF THE INVENTION

It is an object of the present invention to provide an electron gun for a CRT that can make electron beams land over an entire screen area with a uniformly-shaped spot. This and other objects may be achieved by an electron gun having a triode portion composed of three cathodes arranged in a horizontal line and control and screen electrodes sequentially placed next to the cathodes. First to fourth focusing electrodes are sequentially arranged one after another next to the screen electrode. A final accelerating electrode placed next to the fourth focusing electrode.

The first focusing electrode has a first side facing the screen electrode and a second side facing the second focusing electrode. Three circular-shaped beam passage holes are formed in both sides of the first focusing electrode. The second focusing electrode has a first side facing the first focusing electrode and a second side facing the third focusing electrode. Three vertically elongated beam passage holes are formed in the first side facing the first focusing electrode and three circular-shaped beam passage holes are formed in the second side facing the third focusing electrode. The third focusing electrode has a first side facing the second focusing electrode and a second side facing the fourth focusing electrode. Three circular-shaped beam passage holes are formed in the first side facing the second focusing electrode and three vertically elongated beam passage holes are formed in the second side facing the fourth focusing electrode. The fourth focusing electrode has a first side with a common hole for allowing passage of the three electron beams.

A static voltage is applied to the first and third focusing electrodes, a dynamic voltage synchronized with a deflection signal is applied to the second and fourth focusing electrodes, and an anode voltage is applied to the final accelerating electrode.

DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components, wherein.

DETAILED DESCRIPTION

Preferred embodiments of this invention will be explained with reference to the accompanying drawings.

Figure 1:
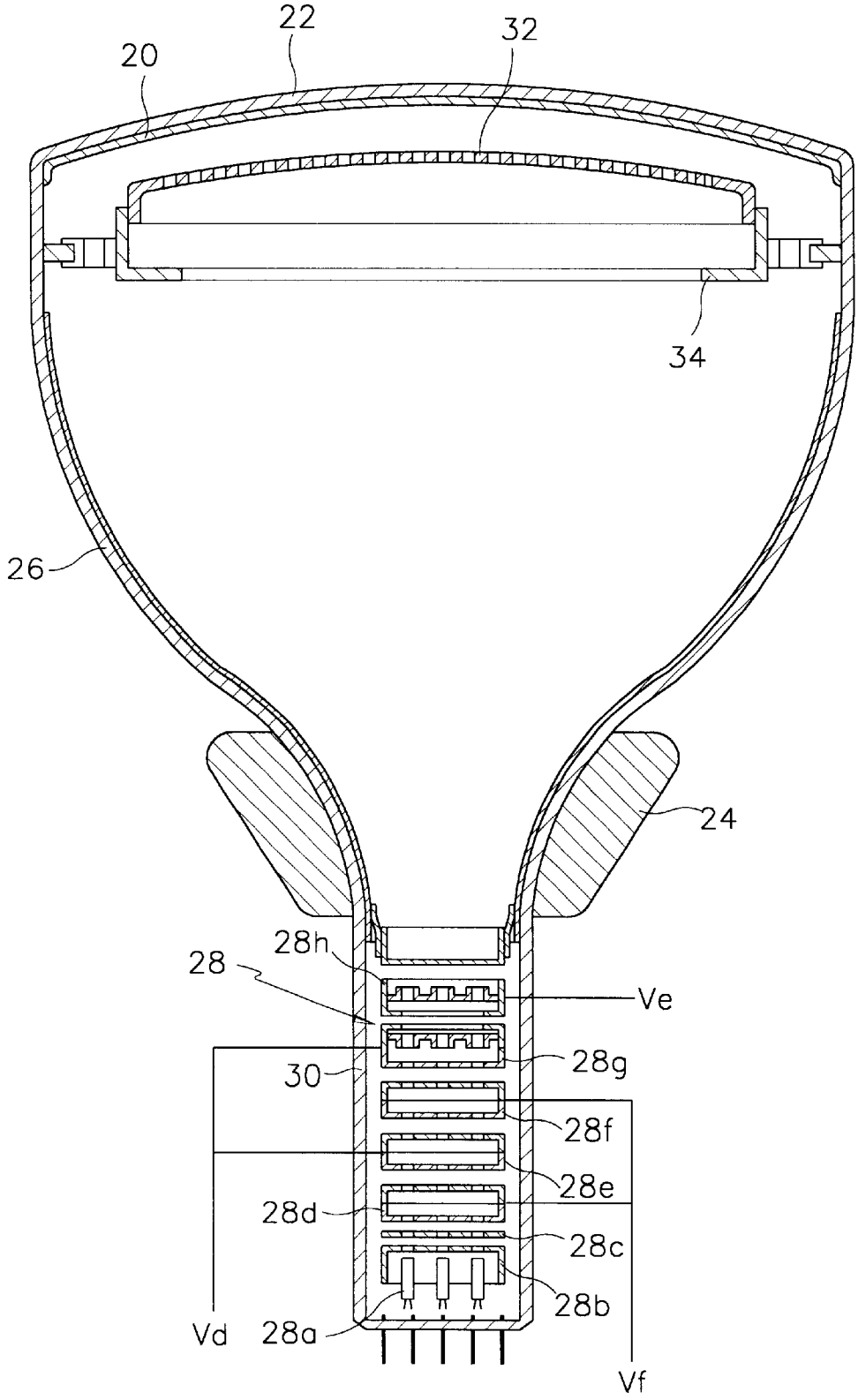
FIG. 1 is a CRT with an electron gun according to a preferred embodiment of the present invention.

As shown in FIG. 1, in a CRT according to a preferred embodiment of the present invention, an electron gun 28 is disposed in the neck 30 of the CRT.

Figure 2:
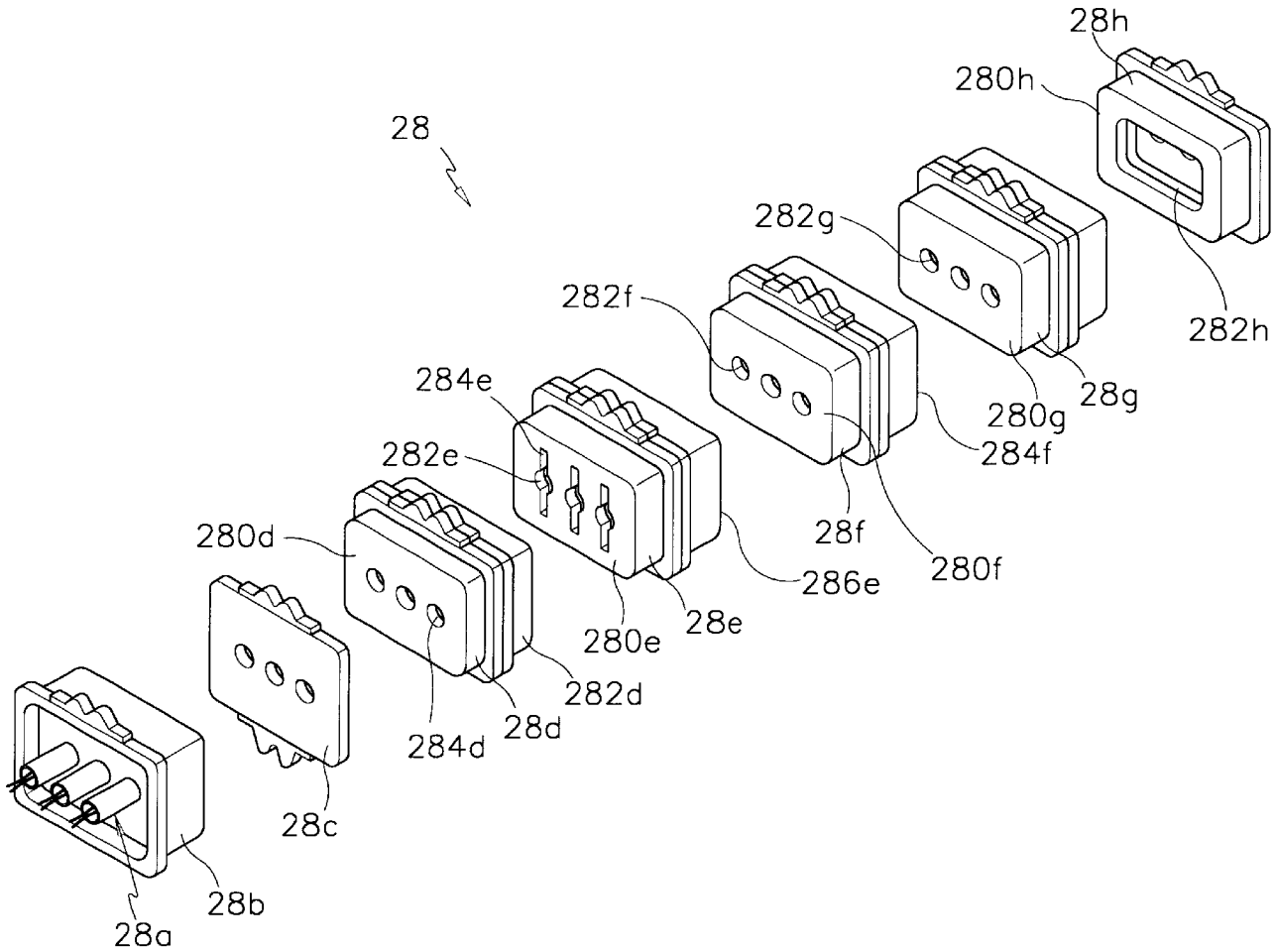
FIG. 2 is an exploded perspective view of the electron gun shown in FIG. 1.

FIG. 2 shows an exploded view of the electron gun 28. The electron gun 28 includes a cathode portion for emitting thermal electrons and an electrode portion placed after the cathode portion to make the emitted thermal electrons into an electron beam. The electron beam passes through the electrode portion while being focused and accelerated before landing on the phosphor screen 20. The electrode portion has holes for allowing the passage of three electron beams, R, G, and B.

The electron gun 28 includes first to fourth focusing electrodes 28*d*, 28*e*, 28*f* and 28*g* sequentially arranged one after another next to the screen electrode 28*c*. Each of the neighboring electrodes 28*d* to 28*g* in operation jointly constitute a dynamic lens.

The first focusing electrode 28*d* has a flat surface 280*d* facing the screen electrode 28*c* and another flat surface 282*d* facing the second focusing electrode 28*e*, and three circular-shaped beam passage holes 284*d* are formed in both surfaces 280*d* and 282*d*.

Figure 3:
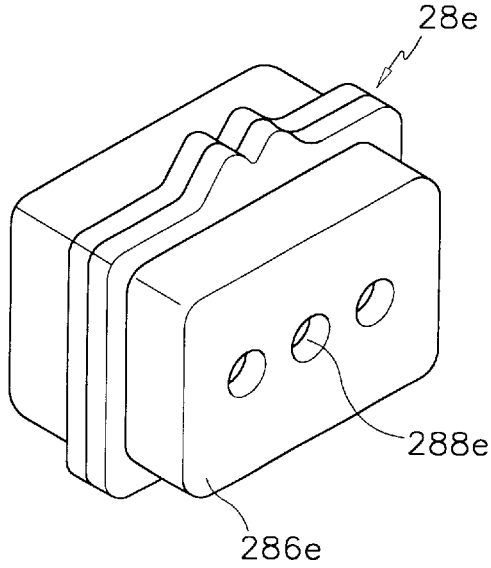
FIG. 3 is a perspective view illustrating a focusing electrode of the electron gun shown in FIG. 1.

The second focusing electrode 28*e* has a flat surface 280*e* facing the first focusing electrode 28*d* and another flat surface 286*e* facing the third focusing electrode 28*f*. Three beam-passage holes 282*e*, each of which is shaped with a center circle having vertically extended side rectangular slots 284*e*, are formed in the surface 280*e* and as shown in FIG. 3, three circular-shaped beam passage holes 288*e* are formed in the other surface 286*e*.

Figure 4:
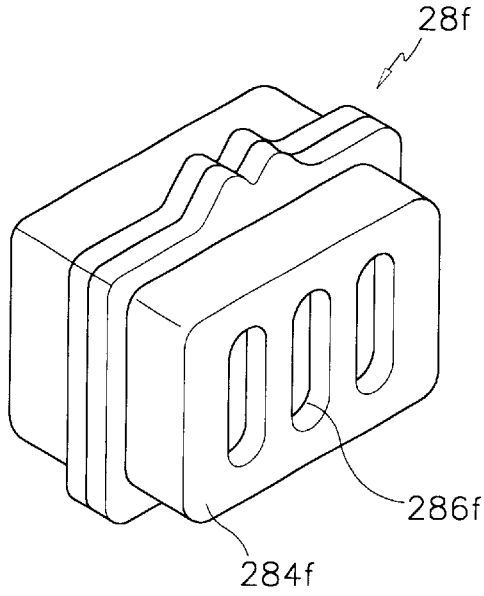
FIG. 4 is a perspective view illustrating another focusing electrode of the electron gun shown in FIG. 1.

The third focusing electrode 28*f* has a surface 280*f* facing the second focusing electrode 28*e* and another surface 284*f* facing the fourth focusing electrode 28*g*. Three circular-shaped beam passage holes 282*f* are formed in the surface 280*f* and, as shown in FIG. 4, three beam-passage holes 286*f*, each of which is shaped with a vertically extended rectangular form having rounded edges, are formed in the other surface 284*f*.

The fourth focusing electrode 28*g* has a surface 280*g* having three circular-shaped beam passage holes 282*g*. The electron gun 28 further includes a final accelerating electrode 28*h* placed next to the fourth focusing electrode 28*g*. One common hole 282*h* is provided at one surface 280*h* facing the fourth focusing electrode 28*g* to allow passage of the three different electron beams.

The aforementioned electrodes of the electron gun 28 are connected to each other using a bead glass (not shown) and installed within the neck 30. In operation, a static voltage Vf is applied to the first and third focusing electrodes 28*d* and 28*f*, whereas a dynamic voltage Vd synchronized with a deflection signal is applied to the second and fourth focusing electrodes 28*e* and 28*g*. The dynamic voltage Vd is a variable voltage that is controlled to make the deflected electron beam land on the peripheral screen portion with a uniformly-shaped spot substantially equal to that of the central portion. An anode voltage Ve is applied to the accelerating electrode 28*h*.

To scan electron beams on the central portion of the screen 20, static voltage Vf is applied to the first and third focusing electrodes 28*d* and 28*f*, and a dynamic voltage Vd equal to the static voltage Vf by peak vs. peak is applied to the second and fourth focusing electrodes 28*e* and 28*g*.

Figure 5:
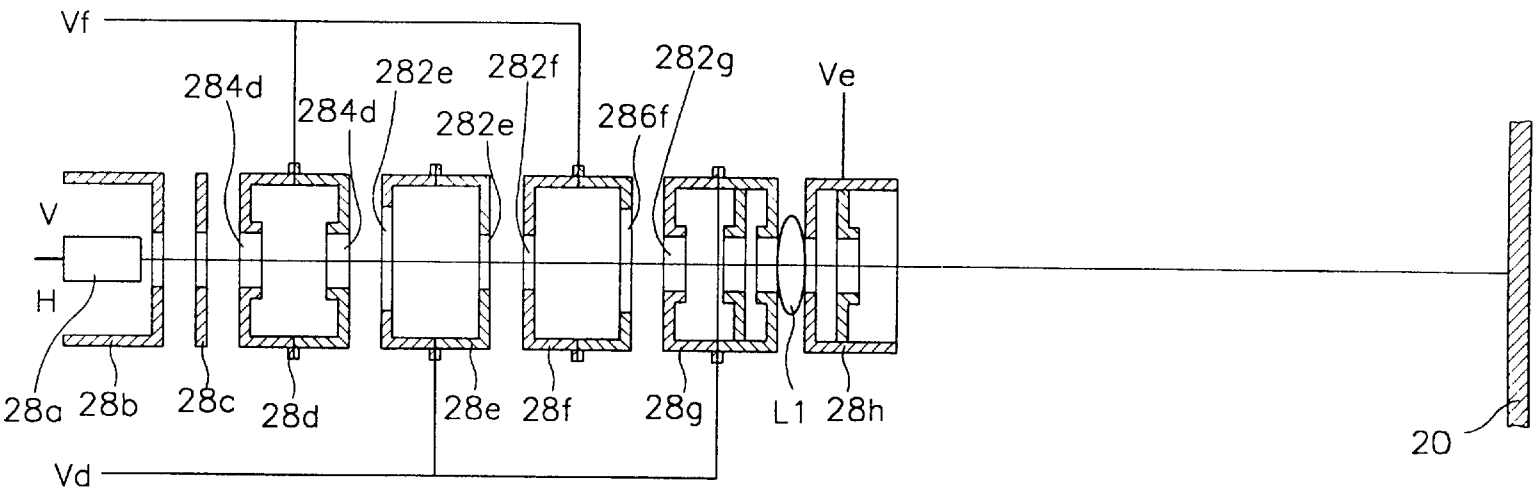
FIG. 5 is a sectional view of the electron gun shown in FIG. 1.

Correspondingly, as shown in FIG. 5, no lens is formed among the first to fourth focusing electrodes 28*d* to 28*g*, whereas a main lens L1 is formed between the fourth focusing electrode 28*g* and the accelerating electrode 28*h*. At this time, the electron beams are simply accelerated and focused by the main lens L1 and land on the central screen portion while keeping their circular shape.

By contrast, when the peripheral portion of the phosphor screen 20 is scanned with electron beams, a dynamic voltage Vd synchronized with a deflection signal from a deflection unit 24 is applied to the second and fourth focusing electrodes 28*f* and 28*g*, whereas a static voltage Vf is applied to the first and third focusing electrodes 28*d* and 28*e*. At this time, the dynamic voltage Vd is higher than the static voltage Vf. Also at this time a non-uniform magnetic field generated by the deflection unit 24 forms a lens 21.

Figure 6:
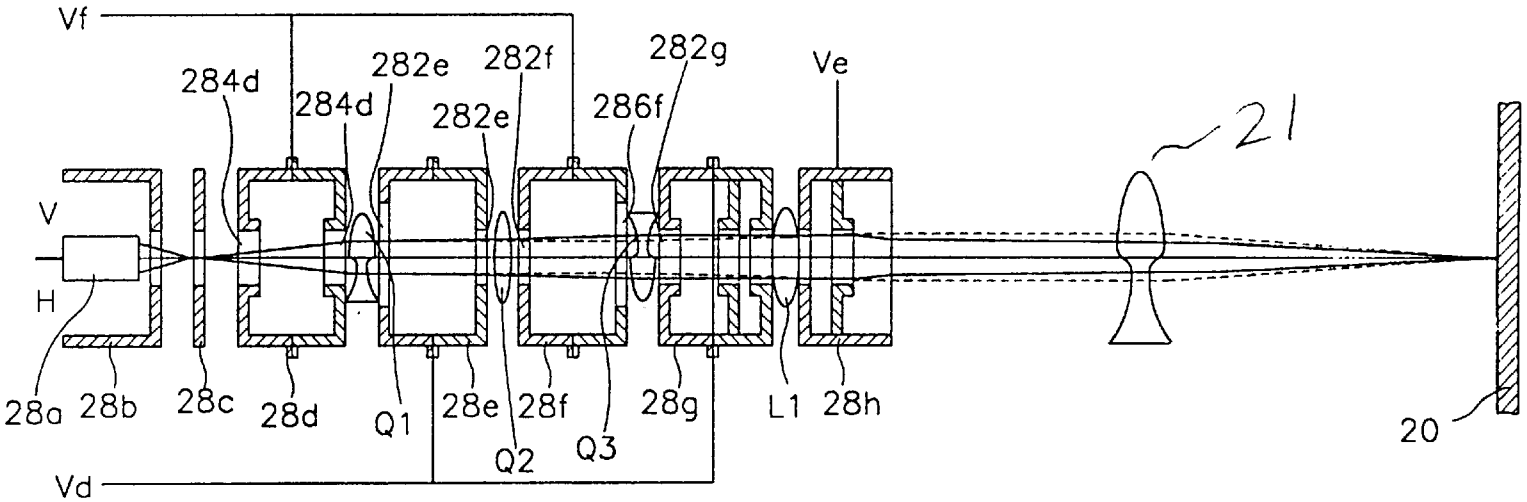
FIG. 6 is a sectional view of the electron gun shown in FIG. 1 illustrating paths of electron beams.

Accordingly, as shown in FIG. 6, a first dynamic lens Q1 is formed between the first and second focusing electrodes 28*d* and 28*e*, a second dynamic lens Q2 between the second and third focusing electrodes 28*e* and 28*f*, and a third dynamic lens Q3 between the third and fourth focusing electrodes 28*f* and 28*g*.

The first dynamic lens Q1 focuses the electron beams in a vertical direction and spreads them in a horizontal direction. By contrast, the third dynamic lens Q3 focuses the electron beams in the horizontal direction and spreads them in the vertical direction. In the second dynamic lens Q2, the vertical and horizontal focusing factors are the same.

Figure 7:
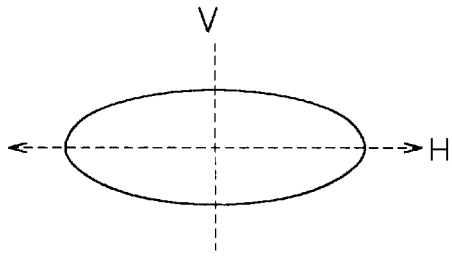
FIG. 7 is a schematic view illustrating a shape of an electron beam according to a preferred embodiment.
Figure 8:
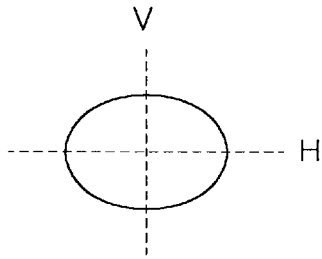
FIG. 8 is a schematic view illustrating another shape of the electron beam according to a preferred embodiment.

In other words, when the electron beam produced from the triode portion passes through the first dynamic lens Q1, as shown in FIG. 7, it is pulled left and right in the horizontal direction. By contrast, when the electron beam passes through the second dynamic lens Q2, as shown in FIG. 8, it is narrowly focused in the horizontal and vertical directions.

Figure 9:
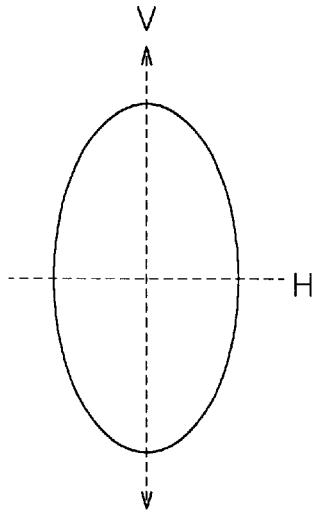
FIG. 9 is a schematic view illustrating still another shape of the electron beam according to a preferred embodiment.

When the electron beam further passes through the third dynamic lens Q3, as shown in FIG. 9, it is pulled in the vertical direction. Hereafter, the electron beam lands on the peripheral screen portion via the main lens L1. In this way, even in case the electron beam is distorted due to a non-uniform magnetic field of the deflection unit 24, the dynamic lenses Q1 to Q3 compensate for the distortion such that the cross section of electron beam landing on the peripheral screen portion has a substantially circular shape.

Furthermore, owing to the aforementioned structure, even in the case of a fluctuation in the dynamic voltage Vd, such an error can be compensated for with the aid of the dynamic lens Q1 to Q3 constituted by the first to fourth focusing electrodes 28*d* to 28*g*.

That is, in case a dynamic voltage Vd lower than the standard value is fed to the second and fourth focusing electrodes 28*e* and 28*g*, the first dynamic lens Q1 pulls the electron beam less in the horizontal direction than when Vd is not lower than the standard value. The second dynamic lens Q2 focuses the electron beam less in the vertical and horizontal directions. Finally, the third dynamic lens Q3 extends the electron beam less in the vertical direction than when Vd is not lower than the standard value.

On the other hand, when a dynamic voltage Vd higher than the standard value is fed to the second and fourth focusing electrodes 28*e* and 28*g*, the first dynamic lens Q1 makes the extends the electron beam more in the horizontal direction than when Vd is not higher than the standard value. The second dynamic lens Q2 focuses the electron beam more in the vertical and horizontal directions. Finally, the third dynamic lens Q3 makes the electron beam more extended in the vertical direction, thereby being in a balanced state.

In this way, even in the presence of an accidental fluctuation in the dynamic voltage Vd, the dynamic lenses Q1 to Q3 automatically compensate for the distortion of the electron beam so that an electron beam with a uniform cross section lands on the peripheral screen portion.

Figure 10:
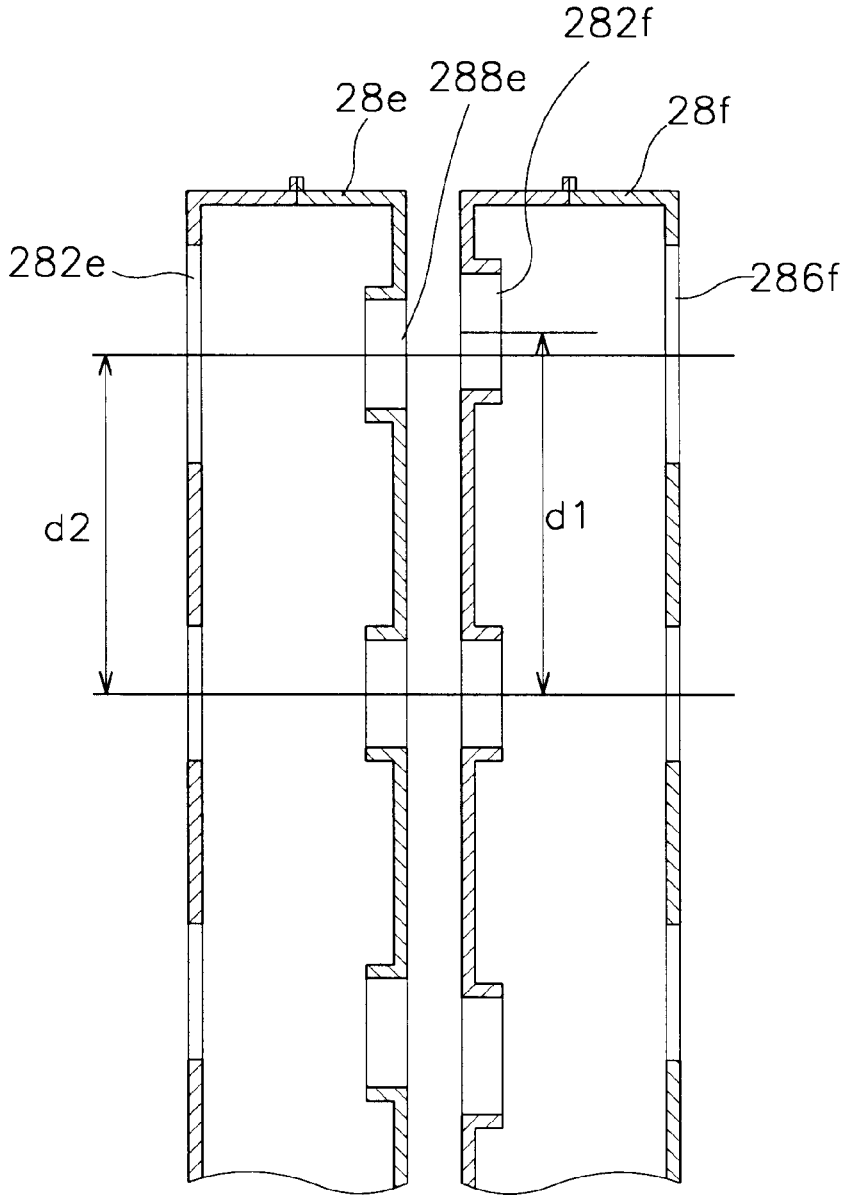
FIG. 10 is a sectional view illustrating an installed state of the focusing electrodes shown in FIGS. 3 and 4.
Figure 11:
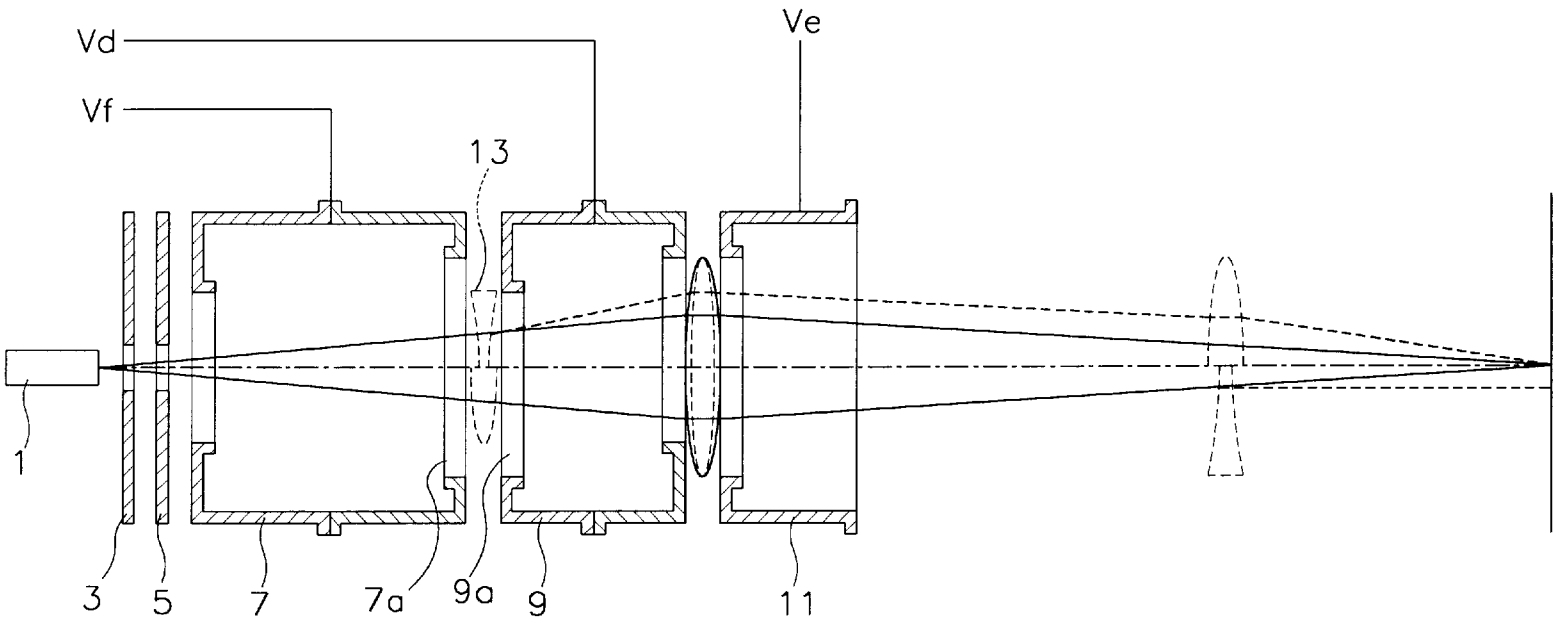
FIG. 11 is a sectional view of a prior art electron gun for CRTs.

As shown in FIG. 10, it is preferable that the distance d1 between the neighboring rectangular-shaped beam passage holes 286*f* formed at the third focusing electrode 28*f* is controlled to be larger than the distance d2 between the neighboring center-circled and vertical slot-sided beam passage holes 282*e* formed at the second focusing electrode 28*e*. In this way, mis-convergence of the side electron beams R and B can be effectively prevented.

As described above, when the peripheral screen portion is scanned with an electron beam, the sequentially arranged focusing electrodes can compensate for distortion of the electron beam due to the non-uniform magnetic deflection fields. Furthermore, even in the presence of an accidental error in the dynamic voltage applied to the electrodes, the resulting distortion of the electron beam is effectively compensated for with the aid of the focusing electrodes so that the electron beam can land on the peripheral screen portion with a uniformly-shaped spot.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. An electron gun for a cathode ray tube, comprising:

first, second, third, and fourth focusing electrodes, wherein the first focusing electrode comprises two parallel surfaces having a plurality of substantially circular-shaped beam-passage holes, the second focusing electrode comprises a surface facing the first focusing electrode and includes a plurality of elongated beam-passage holes, the third focusing electrode comprises a surface facing the fourth focusing electrode and includes a plurality of elongated beam-passage holes, and the fourth focusing electrode comprises a surface with a common hole for allowing passage of electron beams.

2. The electron gun of claim 1 wherein a distance between neighboring elongated beam-passage holes of the third focusing electrode is greater than a distance between neighboring elongated beam-passage holes of the second focusing electrode.

3. The electron gun of claim 1 wherein each of the second and third focusing electrodes comprise a surface facing each other and having a plurality of substantially circular-shaped beam-passage holes.

4. A cathode ray tube comprising:

a faceplate panel;

a funnel sealed to the panel;

a neck connected to a rear of the funnel; and an electron gun mounted within the neck, said electron gun including a triode portion having three horizontally-arranged cathodes, control and screen electrodes sequentially placed next to the cathodes, first, second, third and fourth focusing electrodes sequentially arranged one after another next to the screen electrode, and a final accelerating electrode placed next to the fourth focusing electrode; and a power source having a static voltage coupled to the first and third focusing electrodes, a dynamic voltage coupled to the second and fourth focusing electrodes, and an anode voltage coupled to the final accelerating electrode, wherein the second focusing electrode comprises a surface facing the first focusing electrode and an opposite surface facing the third focusing electrode, and includes a plurality of elongated beam-passage holes, and the third focusing electrode comprises a surface facing the fourth focusing electrode and includes a plurality of elongated beam-passage holes.

5. The cathode ray tube of claim 4 wherein the second and third focusing electrodes each comprise a surface facing each other with circular-shaped beam-passage holes formed thereon.

6. The cathode ray tube of claim 4 wherein each of the elongated beam passage holes is a round shaped hole with a rectangular extension on both the top and bottom of round shaped hole.

7. The cathode ray tube of claim 4 wherein each of the elongated beam passage holes is a substantially rectangular shape having rounded edges.

8. A cathode ray tube comprising:

a faceplate panel;

a funnel coupled to the panel;

a neck coupled to a rear of the funnel;

an electron gun disposed within the neck, the electron gun comprising a triode portion having three cathodes arranged in a horizontal line, control and screen electrodes sequentially placed next to the cathodes, first, second, third and fourth focusing electrodes sequentially arranged one after another next to the screen electrode, and a final accelerating electrode disposed next to the fourth focusing electrode; and a power source having a static voltage is coupled to the first and third focusing electrodes, a dynamic voltage is coupled to the second and fourth focusing electrodes, and an anode voltage is coupled to the final accelerating electrode;

wherein a first dynamic lens is formed between the first and second focusing electrodes, a second dynamic lens is formed between the second and third focusing electrodes, and a third dynamic lens is formed between the third and fourth focusing electrodes; and wherein the first dynamic lens is configured to extend the electron beams in a first direction, the second dynamic lens is configured to focus the extended electron beams in the first direction and a second direction, and the third dynamic lens is configured to extend the focused electron beams in the second direction.

9. The electron gun of claim 1 wherein the elongated beam-passage holes of the second and third focusing electrodes are vertically elongated.

10. The electron gun of claim 4 wherein the elongated beam-passage holes of the second and third focusing electrodes are vertically elongated.

11. The electron gun of claim 8 wherein the elongated beam-passage holes of the second and third focusing electrodes are vertically elongated.

12. The electron gun of claim 8 wherein the first direction is in the horizontal direction and the second direction is in the vertical direction.

* * * * *